United States Patent [19]

Moisan

[11] Patent Number: 4,559,726

[45] Date of Patent: Dec. 24, 1985

[54] SNOW MOVER

[76] Inventor: Marius Moisan, 4822 Legendre St., Contrecoeur, Canada, J0L 1C0

[21] Appl. No.: 671,117

[22] Filed: Nov. 13, 1984

[30] Foreign Application Priority Data

Nov. 16, 1983 [CA] Canada ..... 441336

[51] Int. Cl.[4] ..... E01H 5/06

[52] U.S. Cl. ..... 37/267; 37/285; 294/54.5

[58] Field of Search ..... 37/265, 266, 267, 285; 294/54.5

[56] References Cited

U.S. PATENT DOCUMENTS

| | | | |
|---|---|---|---|
| 992,972 | 5/1911 | Meadows | 37/265 X |
| 2,239,297 | 4/1941 | Allen et al. | 294/54.5 X |
| 2,463,150 | 3/1949 | Camp | 294/54.5 X |
| 2,728,598 | 12/1955 | Szillage | 294/54.5 X |
| 2,919,153 | 12/1959 | Benton | 37/266 X |
| 3,751,094 | 8/1973 | Bohler | 294/54.5 X |
| 3,938,843 | 2/1976 | Pahl | 37/266 |
| 4,103,954 | 8/1978 | Vaslas | 294/54.5 |
| 4,224,751 | 9/1980 | Schoemann et al. | 37/265 |

*Primary Examiner*—Edgar S. Burr
*Assistant Examiner*—Moshe I. Cohen

[57] ABSTRACT

This invention relates to a snow handling equipment comprising a handle grip, a tubular handle, a blade slightly curved in cross section and rectangular in plan and a supporting device securing the blade to the handle. The supporting device allows the pivoting movement of the blade in a plane perpendicular with respect to the plane of the handle to allow the user to adjust the angle of the blade or turn the blade upside down in order to use either edge of the blade to scrape the snow.

4 Claims, 5 Drawing Figures

Fig. 3
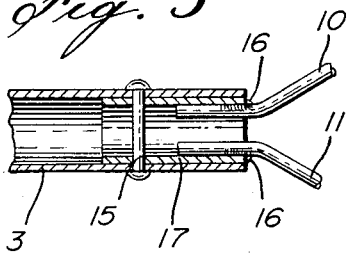
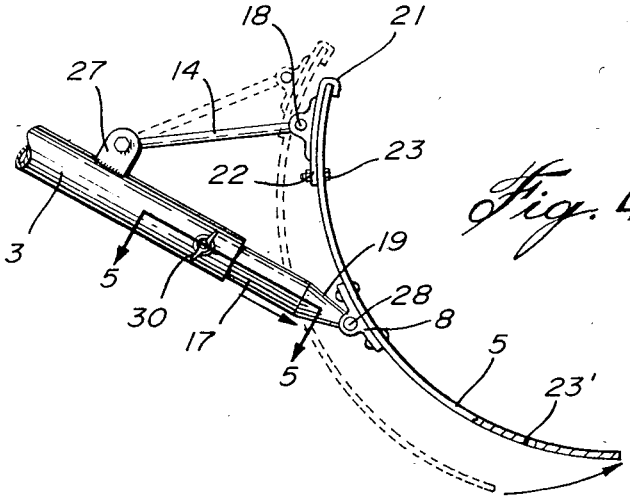
Fig. 4
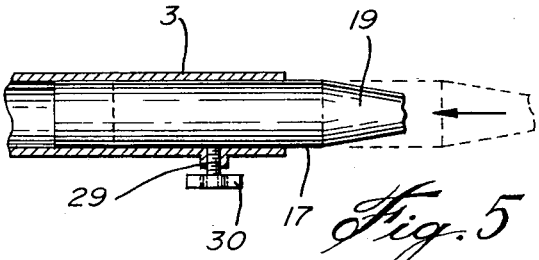
Fig. 5

SNOW MOVER

FIELD OF THE INVENTION

This invention relates to snow movers and move particularly to a manually-operated snow mover.

PRIOR ART

Before, attempts were made to design a hand-operated snow mover comprising a tiltable blade, but it was not possible to turn the blade upside down so as to prolong the life of the snow mover.

OBJECT OF THE INVENTION

It is therefore a primary object of the invention to provide a hand-operated snow mover in which the blade may be adjusted to any desired angle depending on the consistency of the snow and in connection with the height of the person using the tool and to also enable snow shovelling, and in which the blade may be easily reversed if the lower edge is worn out or dented, so that the life of the blade can be prolonged.

BRIEF DESCRIPTION OF THE DRAWINGS

FIG. 3 is a fragmentary sectional view of the shovel handle end section taken along line 3—3 of FIG. 2;

FIG. 4 is a fragmentary side elevation illustrating a second embodiment of the blade adjustment mechanism; and FIG. 5 is a fragmentary sectional view of the second embodiment of the shovel handle end section taken along line 5—5 of FIG. 4.

DESCRIPTION OF THE PREFERRED EMBODIMENTS

Figure 1:
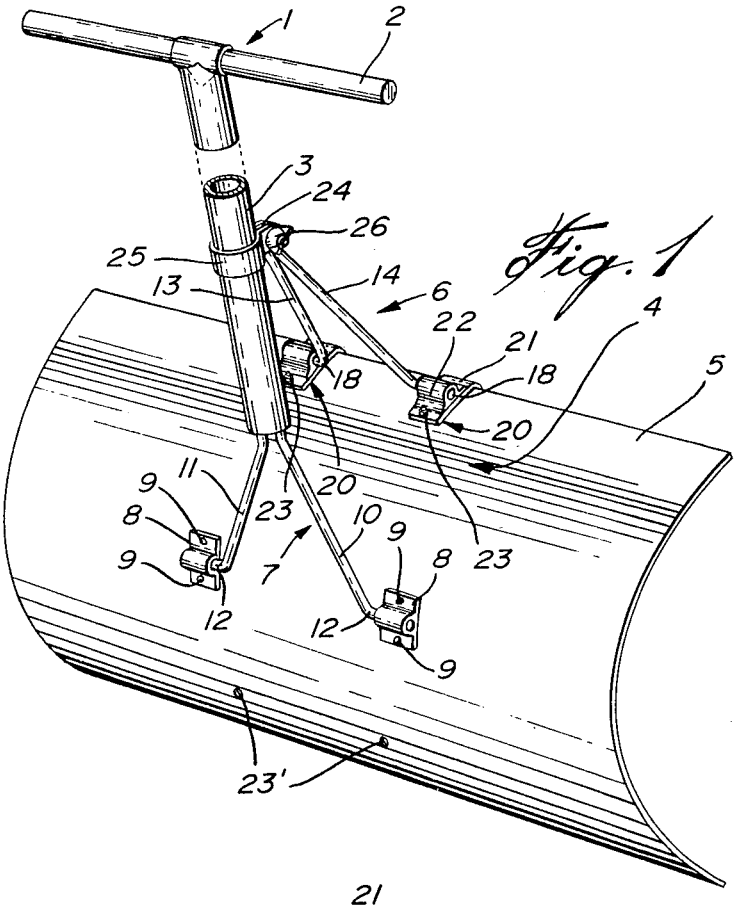
FIG. 1 is a perspective view of the snow mover, the handle being broken away.

Referring to the drawings, the snow mover comprises a handle grip 1 made of a round bar 2 transversely located relative to a handle 3.

The handle grip 1 is secured to the handle 3 which is of tubular section with a hollow center. A blade 5, rectangular in plane and slightly curved in cross-section is attached to the end of handle 3 opposite grip 1.

The materials used in the construction of the snow mover are rigid and rust resistant materials such as aluminum or plastic materials.

An advantage of the "T" shaped handle grip over the conventional handle grips is the increase of force transmitted to the snow mover due to the possibility for the user to hold the handle with his two hands and also to use his body to push on the handle grip.

The blade 5 is pivotally secured to the handle 3 by means of a supporting device 4. The supporting device 4 is made of a lower member and an upper member. The lower member comprises a "U" shaped brace rod 7 having identical but opposite legs 10 and 11 provided with outwardly bent lower shaft segment 12 adapted for positioning in rotative relationship within the brackets 8. The brackets are positioned on either side of the tubular handle 3 and secured to the blade 5 by means of two short rivets 9 or screws. Brackets 8 are located on a straight line substantially equidistant from and parallel to the longitudinal upper and lower edges of blade 5.

The upper section of the legs 10 and 11 are bent along the axis of the tubular handle.

As seen in FIG. 3, a short sleeve 17 slightly smaller in diameter than the inside diameter of the tubular handle 3 is inserted at the lower end of the handle 3 and secured by means of a rivet 15 or screw.

The upper section of the legs 10 and 11 are inserted inside sleeve 17 and welded at 16 into place. Legs 10 and 11 and sleeve 17 form a rigid extension of handle 3.

The upper member is made of a "U"-shaped rod 6 having legs 13 and 14 each provided with an outwardly bent lower shaft segment 18 adapted for positioning in rotative relationship within removable brackets 20 provided with a first hook-shaped end 21 bent over the upper edge of the blade 5 and having the opposite end 22 removably secured to the blade 5 by means of a bolt and nut 23. The bolts 23 extend through the holes 23' nearer the blade upper edge, there being another set of holes 23' nearer the blade lower edge. The upper section of the legs 13 and 14 forms a loop 24 which is secured to a collar 25 by means of a screw and wing nut 26. The collar 25 is slidably and rotatably mounted on the exterior surface of the handle 3.

The efficiency of a conventional snow mover is soon reduced due to the wear of the lower edge of the blade caused by the friction with a hard concrete surface. An advantage of the present invention is the possibility to rotate the blade in order to use the upper edge of the blade when the lower one is worn or dented.

In order to reverse the blade 5, remove both brackets 20 by unscrewing the bolt 23 and releasing the hook-shaped end 21 which is curved around one edge of the blade 5. When the blade 5 is free from the upper "U"-shaped rod 6 it will tilt around the lower"U"-shaped rod 7 in a position where the upper and lower edges of the blade 5 are now inverted.

When the blade is in the right position, rotate collar 25 through 180° around handle 3 and secure the two removable brackets 20 on the worn edge of the blade 5 the same way they were secured on the other edge while using the set of holes 23' made in blade 5 nearer its worn edge.

Figure 2:
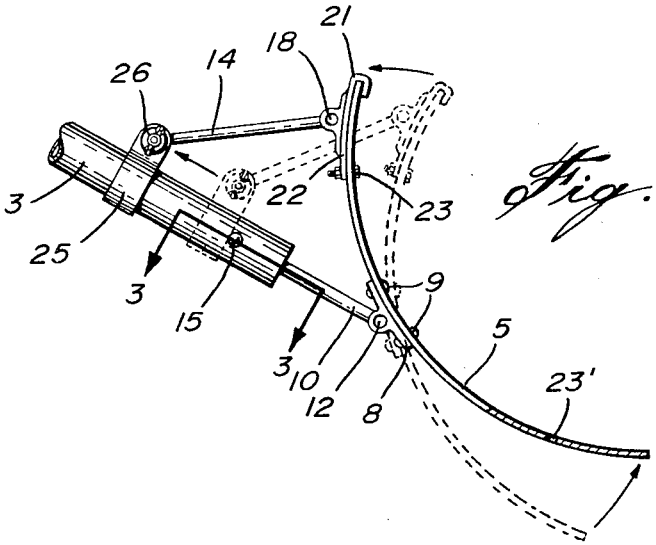
FIG. 2 is a fragmentary side elevation showing the blade angle adjustment mechanism.

Another advantage of the invention is the possibility to adjust the angle of the blade, as shown in FIG. 2, depending on the height of the user, to obtain the most comfortable and effortless position. Wing nut 26 is untightened, collar 25 slid to a new position on handle 3 and wing nut 26 retightened. When blade 5 is adjusted to a position nearly parallel to handle 3, it can be used for snow shovelling.

In a second embodiment of the invention, the collar 25 is replaced by a bracket 27 welded on the handle 3. The lower U-shaped rod 7 is replaced, as shown in FIG. 5, by a conical prolongation 19 of a sleeve 17, ended by a transverse pin 28 adapted for positioning in rotative relationship within the brackets 8.

The sleeve 17 of the second embodiment forms an end section of handle 3 which is slidably and rotatably telescoped inside the handle 3, and adjustably secured into adjusted longitudinal and rotated position by a screw 29 ended by a winged knob 30, located at the lower end of the handle 3. To adjust the angle of the blade, unscrew the screw 29 and slide up or down the sleeve 17 along the handle 3. The blade is reversible as in the first embodiment and by rotating sleeve 17 one-half turn in handle 3.

The terms first, second, and third bracket means referred to in the claims are embodied by brackets 8, 21, and collar 25, or bracket 27, respectively, in both embodiments. The terms first, second, and third pivotal axes used in the claims refer to parts 12, 18, and 26, respectively, in FIG. 2 and to parts 28, 18, and to the pivot of link 14 to bracket 27, respectively, in FIG. 4.

What I claim is:

1. A snow mover comprising an elongated handle having a manual grip at one end, a blade slightly curved in cross-section to define a convex rear face and a concave front face, said blade rectangular in plan and having opposite parallel longitudinal edges, first bracket means fixed to said blade at said back face to the central portion of said blade, both longitudinally and transversely thereof, the opposite end of said handle pivoted to said first bracket means for pivotal movement about a first pivot axis parallel to and substantially equidistant from said two longitudinal edges, second bracket means detachably securable to said blade at said back face adjacent either one of said two longitudinal edges at the longitudinally central portion of said blade, securing means for removably securing said second bracket means to said blade, third bracket means fixed to said handle at a distance from said opposite end, link means extending between said second and said third bracket means and pivotally secured to the same at its ends about second and third pivot axes parallel to said first pivot axis, said three pivot axes defining the apices of a triangle, means to adjust the distance between said first and said third pivot axes to adjustably change the angle of said blade in relation to said handle, and means to rotate one of said first and third bracket means through at least 180° about the longitudinal axis of said handle.

2. A snow mover as defined in claim 1, wherein said third bracket means include a collar slidably and rotatably mounted around said handle, said collar having a locking device to lock said collar in any rotated position and at selected positions along said handle.

3. A snow mover as defined in claim 1, wherein said handle is made of a major tubular section and of a minor section pivoted to said first bracket means about said first pivot axis and telescopically engaged within said tubular section for slidably and rotated adjustment therein, and further including a locking device releasably locking said minor section in adjusting longitudinal and rotated position within said tubular section.

4. A snow mover as defined in claim 1, wherein said securing means include first and second holes made through said blade adjacent to and equidistant from the respective longitudinal edges of said blade, third holes made in said third bracket means on one side of said second pivot axis, hooks carried by said second bracket means on the other side of said second pivot axis and engageable with either one of said two longitudinal edges, and fastener means removably extending through said third holes and through one or the other of said first and second holes.

* * * * *